US011780200B2

(12) United States Patent
Vollenkemper

(10) Patent No.: US 11,780,200 B2
(45) Date of Patent: Oct. 10, 2023

(54) DEVICE AND METHOD FOR PRODUCING AT LEAST ONE EMPTY OPEN BAG

(71) Applicant: HAVER & BOECKER OHG, Oelde (DE)

(72) Inventor: Willi Vollenkemper, Oelde (DE)

(73) Assignee: HAVER & BOECKER OHG, Oelde (DE)

( * ) Notice: Subject to any disclaimer, the term of this patent is extended or adjusted under 35 U.S.C. 154(b) by 257 days.

(21) Appl. No.: 17/261,447

(22) PCT Filed: Jul. 11, 2019

(86) PCT No.: PCT/EP2019/068663
§ 371 (c)(1),
(2) Date: Jan. 19, 2021

(87) PCT Pub. No.: WO2020/020651
PCT Pub. Date: Jan. 30, 2020

(65) Prior Publication Data

US 2021/0237388 A1 Aug. 5, 2021

(30) Foreign Application Priority Data

Jul. 24, 2018 (DE) ..... 102018117871.9

(51) Int. Cl.
*B31B 70/00* (2017.01)
*B31B 70/26* (2017.01)
*B31B 155/00* (2017.01)

(52) U.S. Cl.
CPC ..... *B31B 70/006* (2017.08); *B31B 70/004* (2017.08); *B31B 70/261* (2017.08); *B31B 2155/003* (2017.08)

(58) Field of Classification Search
CPC ... B31B 70/006; B31B 70/004; B31B 70/261; B65B 1/02
See application file for complete search history.

(56) References Cited

U.S. PATENT DOCUMENTS 3,973,474 A * 8/1976 Auckenthaler ..... B65B 1/02 493/197
4,004,398 A 1/1977 Larsson et al.
(Continued)

FOREIGN PATENT DOCUMENTS

CH 373683 A 11/1963
CN 102673835 A 9/2012
(Continued)

OTHER PUBLICATIONS

Vollenkemper, Machine Translation of WO 2016/046312 A1, Mar. 31, 2016 (Year: 2022).*
(Continued)

*Primary Examiner* — Anna K Kinsaul
*Assistant Examiner* — Veronica Martin
(74) *Attorney, Agent, or Firm* — Greer, Burns & Crain, Ltd

(57) ABSTRACT

Apparatus for manufacturing an open-mouth bag of at least one layer of a flexible bag material, and method of manufacturing a bag by such apparatus. The apparatus includes a shaping device with a shaping box in the contour of the bag shape to be formed, with a top end and a bottom end, a conveying device for transporting the bag material along the shaping box, a closing device for joining the bag material along the shaping box to form a tube, and a closing station for generating a bag bottom, which is disposed beneath the bottom end of the shaping box. A partial vacuum device is configured to generate intermittently, a partial vacuum. When manufacturing a bag, the bag material is draped around the shaping box in the contour of the bag shape to be formed as continuous material and is joined to form a tube by the closing device.

12 Claims, 5 Drawing Sheets

(56) References Cited

U.S. PATENT DOCUMENTS

| | | | | |
|---|---|---|---|---|
| 5,732,535 | A * | 3/1998 | Mitsuta | B60P 7/065 53/512 |
| 10,589,881 | B2 | 3/2020 | Vollenkemper et al. | |
| 10,625,890 | B2 | 4/2020 | Vollenkemper et al. | |
| 2010/0210438 | A1 * | 8/2010 | Nakagawa | B65B 51/306 493/186 |

FOREIGN PATENT DOCUMENTS

| | | | | |
|---|---|---|---|---|
| DE | 1586328 | A1 | 1/1971 | |
| DE | 2519631 | A1 | 11/1976 | |
| WO | WO-2016046312 | A1 * | 3/2016 | B65B 1/32 |

OTHER PUBLICATIONS

International Search Report and Written Opinion received for PCT/EP2019/068663, dated Nov. 12, 2019.
German Search Report received for Application No. 10 2018 117 871.9, dated Feb. 27, 2019.
Chinese First Office Action and Search Report received for Application No. 201980048630.7, dated Jul. 4, 2022.

* cited by examiner

DEVICE AND METHOD FOR PRODUCING AT LEAST ONE EMPTY OPEN BAG

BACKGROUND

The present invention relates to an apparatus for manufacturing at least one open-mouth bag or pouch made of at least one layer of a substantially flexible bag material. Such an apparatus comprises at least one shaping device with at least one substantially tubular shaping box having a top end and a bottom end showing the contour of the bag to be formed. At least one conveying device is provided for transporting the bag material along the shaping box, and at least one closing device serves to join the bag material along the shaping box to form a tube. Furthermore, at least one closing station for making a bag bottom is provided, disposed beneath the bottom end of the shaping box. Moreover, the present invention relates to a method of manufacturing a bag by means of such an apparatus.

Bags filled with bulk material such as cement, high-quality tile grout or other construction materials and having a relatively low weight, may be referred to as pouches or small pouches.

These bags tend to be manufactured immediately prior to filling, in a device installed upstream of the apparatus. To this end for example a flat sheet is pulled over a shaping shoulder and the flat sheet is then guided over a mold element and welded together to obtain a tubular film. Bottom seams are inserted in regular intervals, and a bag showing the desired size and height is cut off of the tube.

A bag or pouch thus manufactured can then be conveyed further to an appropriate system or station for filling with bulk material, or can be filled directly through the shaping box. The bulk material to be filled in is filled into the tube section or bag until the desired weight or volume is obtained. Then the top seam is made and the bag filled with the bulk material is cut off.

The manufacturing of a bag from a single layer of bag material preceding the filling with bulk material is basically functional. A drawback thereof is that the bags made in known systems do not always show the precise shape or cross section actually intended.

In the example of a system employing a film, this is caused in that first, a bottom seam is made in the tubular film so as to generate a tubular film closed on one of its ends. Then the tubular film is conveyed further until the desired bag height is obtained. Now, the bottom seam of the following bag is made in the tubular film and the generated bag blank is cut off of the remainder of the tubular film beneath the tube seam, and inserted for example in a transport box which conveys what is now an open-mouth bag to the filling station.

As a rule, however, bags thus manufactured show at least slightly bulging side walls. This is caused by the fact that when the welding jaws are closing for making the seam for the bag bottom of the following bag, air is pressed out of the tubular film into the previously manufactured bag blank. Since it is closed by the bottom seam, excess pressure is generated in the bag blank until it is cut off of the remainder of the tubular film.

Now, although the pressure escapes from what is now an open-mouth bag, the slightly outwardly bulging side walls do not regain their originally provided shape predetermined by the mold element.

Thus, the handover to a transport box or the sliding of a bag into the transport box cannot always function reliably due to the low own weight or empty weight. Moreover, in particular in the case of a bag filled with highly compacted bulk material the shape does not show the desired outer contour.

Likewise, the excess pressure generated by the closing welding jaws, in particular in the case of gusseted pouches, may cause shifting of the film layers relative to one another or wrinkle formation, thus in turn resulting in poor weld seam quality.

It is therefore the object of the present invention to improve the drawbacks described above in manufacturing open-mouth bags.

SUMMARY

The apparatus according to the invention is provided for manufacturing at least one empty open-mouth bag made of at least one layer of a substantially flexible bag material. This apparatus comprises at least one shaping device having at least one shaping box, which is substantially configured in the contour of the bag shape to be formed and comprises a top end and a bottom end. Furthermore, at least one conveying device is provided for transporting the bag material along the shaping box. Moreover the apparatus comprises at least one closing device for joining the bag material along the shaping box to make a tube, and at least one closing station for making a bag bottom, which is disposed beneath the bottom end of the shaping box. According to the invention, at least one partial vacuum device is provided which is suitable and configured to generate, at least at the bottom end of the shaping box, at least intermittently, at least a minimal, partial vacuum.

The partial vacuum device is preferably suitable and configured to generate the partial vacuum prior to and/or during the manufacture of the bag bottom.

The apparatus according to the invention manufactures open-mouth bags, preferably indexed or continuously. The substantially flexible bag material is first fed to the shaping box, draped around it, and then conveyed along the shaping box in the transporting direction from the top end towards the bottom end. The conveying device, which is configured suitably, is provided therefor. In an advantageous configuration the conveying device comprises at least one conveyor strap which presses the bag material against, and conveys it along, the transport box.

The bag material is joined along the shaping box by means of the closing device to form a tube, wherein the tube is subsequently closed by means of the closing station, so as to manufacture a bag bottom.

The tube with its closed bottom is then conveyed further until the closing station manufactures the bag bottom of the next bag. As soon as the closing station has closed for making the bag bottom, manufacturing the bag bottom urges the air contained in the closed tube, also in the direction of the preceding bag or the preceding bag bottom.

After manufacturing the bag bottom of the next bag, the preceding or bottommost bag is cut off, preferably by means of a separator, and conveyed off, and the tube with the inserted bag bottom of the next bag is conveyed further.

Since air is also urged into the preceding bag, it is slightly inflated as the next bag is made, or as the bag bottom of the next bag is made. Although this excess pressure forming in the bag can escape as the finished open-mouth bag is cut off, the bag walls do not necessarily regain their shape but retain their inflated form with the side walls of the bag slightly urged outwardly. This is a drawback for example in handover to a transport box. Then, the contour of the filled bag does not correspond to the predetermined or desired shape either.

Therefore, in particular prior to and/or during manufacturing the bag bottom of the next bag, a partial vacuum is generated in the tube by means of the partial vacuum device, so that the bag material of the bag to be cut off now, is drawn slightly inwardly prior to manufacturing the bag bottom of the next bag. Depending on the material thickness and the material stiffness, the generated partial vacuum relative to the ambient pressure may show values of a few pascals up to several hectopascals.

An advantage thereof is that although air is still displaced into the preceding bag, which is now cut off when manufacturing the bag bottom of the following bag, that bag is not inflated but deflated back, or reshaped, to its normal form. Thus, an optimally shaped bag can be manufactured in the shape or contour of the shaping box as the open-mouth bag is cut off. It can be optimally transferred to a shaping box since the bag material does not bulge or buckle outwardly. The shape of the filled bag also corresponds to the shape predetermined by the shaping box.

Moreover, generating a slight partial vacuum in the first bag when manufacturing the bag bottom of the next bag, prevents warpage in the bag material due to tension stresses which would result in less than optimal bag bottoms or closing seams.

The apparatus according to the invention is suitable for manufacturing empty open-mouth bags made of at least one layer of a substantially flexible bag material. This bag material may be provided for example by a sheet of film and/or a paper sheet, woven material, other materials, or combinations thereof. The use of multiple layers or only partially multilayered materials may also be employed or used advantageously.

The bag material is in particular provided as a continuous material, which is in particular understood to include material supplies of material stored on a roll, which rolls are exchanged or joined as required. The materials of the individual rolls may in particular be joined to result in a virtually continuous material, so that the material does not require reloading. The bag material may for example be fed from this material supply to the shaping device or the shaping box.

The shaping device preferably comprises at least the shaping box, which is in particular tubular, and at least one shaping shoulder. A shaping shoulder is in particular understood to mean a component by means of which the substantially flexible bag material is reshaped or preshaped such that it is properly fed to the shaping box or guided around the shaping box. Thus, the bag shape or bag contour may be formed around the shaping box from a layer of bag material, so that the closing device makes a tube in the basic shape or cross section of the intended open-mouth bag.

According to the invention the closing device serves to make a tube from the layer of bag material draped around the shaping box. The closing device is preferably configured such that it suitably joins the currently employed bag material. In particular if film is used, a welding station may be provided for making a longitudinal seam in the bag material, wherein the film placed around the shaping box is caused to slightly or at least minimally overlap. In the case of paper being used for the bag material, the closing device may be configured as a gluing or splicing station. However, for example when paper is used, coating or another material may be provided in the overlap area for joining the layer of bag material to form a tube, so as to enable, other than a splicing process, another closing option such as welding.

Depending on the configuration of the open-mouth bag to be manufactured, in particular at least one device for forming gussets and/or at least one device for impressing or inserting the bag material for making the bag bottom may also be associated with the closing station for making the bag bottom.

The bags manufactured by means of the apparatus according to the invention are then preferably transferred into a transport box or the like and then transported to a packaging system, which is in particular separate. This is where the bag is preferably transferred from the transport box into a stock container and thereafter filled in the packaging system.

The apparatus according to the invention offers many advantages. It is a considerable advantage that, as described above, the tube of film material, the bottom end of which is closed by the bottom seam, is at least slightly drawn inwardly prior to and/or during making of the bag bottom of the following bag. Thus, the bag cut off after making the bag bottom of the next bag is not inflated when making the bag bottom of the next bag, which would cause the side walls of the bag provided to be cut off to swell outwardly.

As a rule, the film material tends to not return satisfactorily to the original shape of the shaping box after cutting off the bag. Thus, handover to a transport box or handover box would not have the bag glide in optimally due to its low own weight, so that reliable operation of the system would not be ensured. The bag shape or the even contact of the bag walls with the handover box would also deviate from specifications. This is prevented according to the invention.

Preferably the partial vacuum device comprises at least one partial vacuum line and/or at least one piston and/or at least one Venturi device or any other type of partial vacuum generation. Thus, for example a partial vacuum line or a suction line may be provided which generates an at least minor partial vacuum on the bottom face or at the bottom end of the shaping box. This is an advantage in particular in the case of a not completely closed system, in particular with a system closed in terms of flow dynamics, a piston may be used alternately, wherein, depending on the stroke length or the piston stroke settings, air is suctioned out of the tube or the shaping box, so that the bag walls move slightly inwardly. A valve device may also generate the partial vacuum, for example with an air flow streaming past an opening of the shaping box, thus drawing out air by way of the Venturi effect, so that a partial vacuum may also be generated on the bottom face of the shaping box.

Particularly preferably the shaping box comprises at least one clear flow cross-section from the top end to the bottom end, with the top end of the partial vacuum device being connected with the clear flow cross-section. For reasons of design, the top end is understood to mean an upper section of the shaping box where the bag material is not guided around the shaping box, at least not yet across the entire surface. Thus, the partial vacuum device may be connected with the shaping box without interfering with transporting the bag material along the shaping box.

In useful configurations, the shaping box is configured tubular or manufactured by bending over or reshaping for example a metal sheet. Thus, a hollow shaping box is provided. If it is substantially closed at its top end, the application of a partial vacuum generates a partial vacuum at the bottom end of the shaping box.

In preferred configurations the clear flow cross-section and the partial vacuum device do not provide a completely closed system. By means of what is an intended leakage, which is in particular obtained by the configuration of the shaping box, it may be ensured that even in the case of a permanently applied partial vacuum, no vacuum is pulled into the tube, which is closed at least on one side, which would result in the tube collapsing or even in the tube being drawn into the shaping box.

In convenient configurations, at least one suction intake is disposed on the shaping box. Such a suction intake may in particular be provided at the top end, for example for connection with a suction line or a tube. Again, the top end is understood to show that in this region of the shaping box, the shaping box is not yet encircled in the bag material over its entire surface.

Preferably the partial vacuum generated by the partial vacuum device is adjustable. To this end, for example a valve and/or a throttle and/or an entrained air flap may be provided with which to adjust the strength of the generated partial vacuum or to activate or deactivate the generating of a partial vacuum. The partial vacuum may be adjusted via an impulse, with the strength of the partial vacuum being generated via the pulse length or the vibrations of the air flow.

Particularly preferably at least one transport plunger is disposed at the bottom end of the shaping box, and is at least minimally displaceable in the transporting direction of the bag material. Such a transport plunger is in particular configured such that it can be displaced into the transport box at least in sections, and continues the contour of the shaping box at least in sections. To this end the transport plunger can in particular be configured substantially conical. Such a transport plunger serves in particular to subsequently convey further the film material tube or the bag to be cut off, even in the case that, depending on the construction of the apparatus, the conveying device has lost contact with the bag material in the region of the bottom end of the shaping box. Then the transport plunger aids with pushing off the film for conveying further.

In expedient configurations at least one through hole is provided in the transport plunger. This configuration allows to generate a partial vacuum in the tube, even if a transport plunger is provided which by its contour would substantially close the bottom end of the shaping box and during conveying further, air can flow into the generated hollow space.

Preferably, at least one pressure line can be guided through the shaping box. Such a pressure line is preferably suitable and configured to generate at least a minimal excess pressure in the tube or in the tube closed at one end by the bag bottom of a bag. Such a pressure line in particular serves to transport bags or to push off the film in conveying further and/or to straighten out the tube gliding off the shaping box. In particular if a transport plunger is used, such a pressure line is guided through the transport plunger, or a corresponding opening is provided in the transport plunger through which the pressure line can introduce excess pressure into the tube made of a film material. This pressure line allows to additionally aid with continued air flow through the opening in the transport plunger.

Preferably at least one separator is attributed to the closing station. Such a separator cuts off the previously formed bag during or after manufacturing the bag bottom of a following bag, so as to manufacture a bag open at one end. Such a separator may be provided for example by a fly cutter, which may be disposed downstream of the closing station or incorporated in the closing station. Depending on the configuration, pushing and/or drawing knives may be used. In particular if film is used for the bag material, the previously shaped bag may be thermally cut off when manufacturing the bag bottom of the following bag. To this end, for example a thermal welding jaw may be provided, which is incorporated in the closing station or provided by the closing station. It may be shaped such that concurrently with manufacturing a bag bottom, the bag still appended beneath is cut off thermally. It must be ensured that the thermal cutting off does not cause the film layers of the open top end of the manufactured bag to adhere to one another.

The method according to the invention is suitable for manufacturing at least one open-mouth bag by means of an apparatus as described above. At least one layer of a substantially flexible bag material is draped around the shaping box in the contour of the bag shape to be formed, in particular as continuous material. By means of the closing device the bag material is joined to form a tube which is conveyed further along the shaping box. Beneath the shaping box a closing station is disposed which manufactures the bag bottom of the bag to be formed. According to the invention, at least prior to and/or during manufacturing the bag bottom of the next bag, at least a minimal partial vacuum is generated in the tube of the bag material by means of the partial vacuum device.

The method according to the invention also offers the advantages described above relating to the apparatus.

A finished bag is preferably cut off by means of the separator as the bag bottom of the next bag is made.

Particularly preferably the transport of the tube is assisted by displacement of at least one transport plunger, which can preferably move in the transporting direction and counter to the transporting direction.

In expedient configurations the excess pressure device can at least temporarily, at least also or additionally, generate at least a minimal excess pressure in the tube, so as to assist with transporting the tube further along the shaping box, or with pushing the film off at the end of the shaping box.

BRIEF DESCRIPTION OF THE DRAWINGS

Further advantages and features of the present invention can be taken from the exemplary embodiment which will be described below with reference to the enclosed figures.

The figures show in.

DETAILED DESCRIPTION

Figure 1:
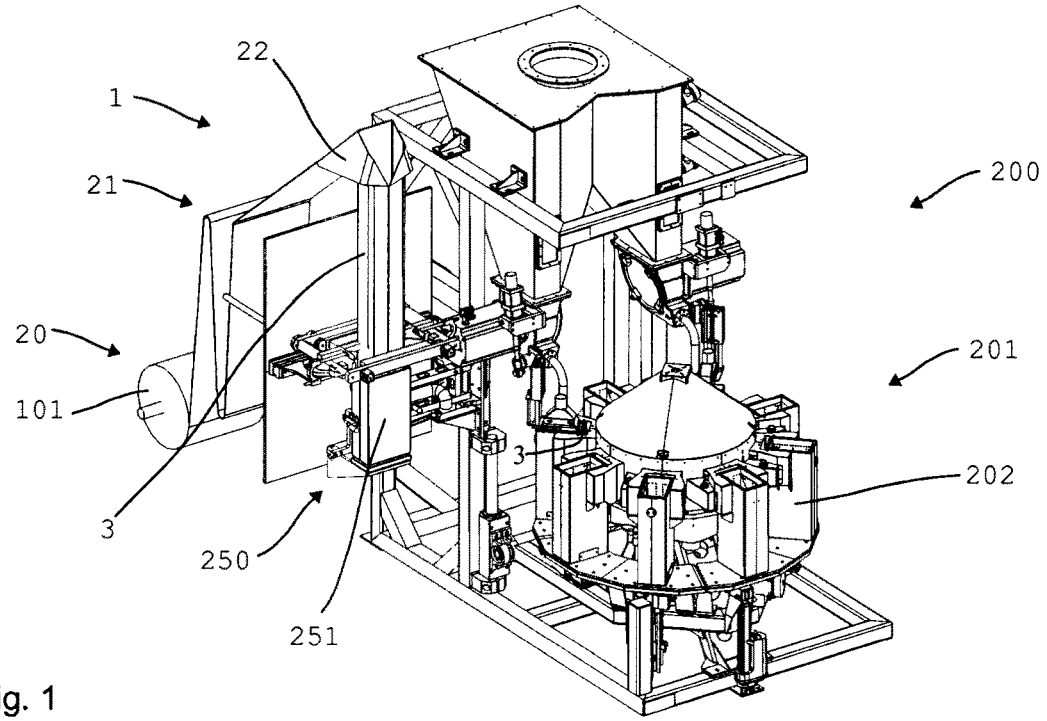
FIG. 1 a schematic illustration of a perspective total view of a filling apparatus for bulk goods with an upstream apparatus according to the invention for manufacturing a bag.
Figure 2:
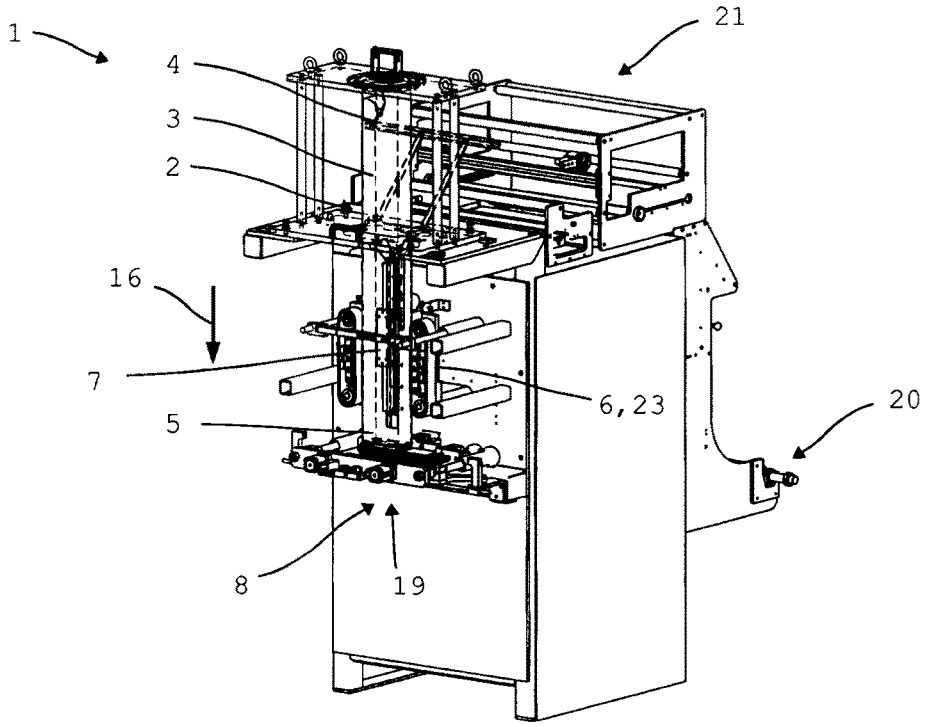
FIG. 2 a schematic illustration of a perspective view of an exemplary embodiment of an apparatus according to the invention for manufacturing an open-mouth bag.
Figure 3:
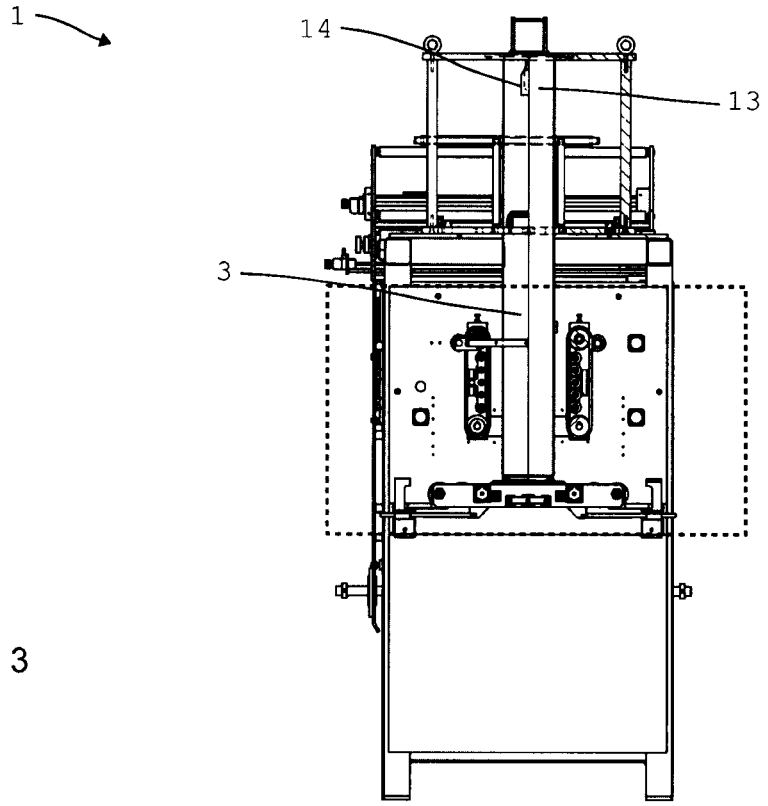
FIG. 3 a schematic illustration of a front view of an exemplary embodiment of an apparatus according to the invention for manufacturing an open-mouth bag (some components have been omitted for better clarity)
Figure 4:
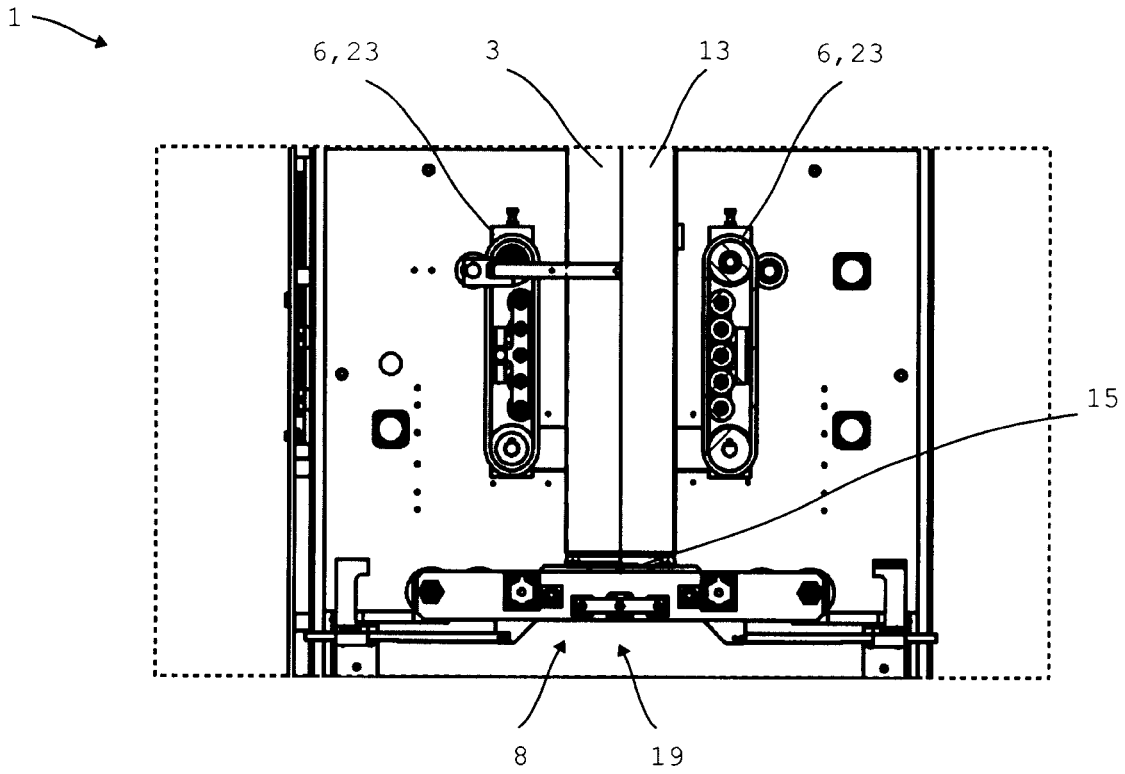
FIG. 4 an enlargement of the marked area in FIG. 3.
Figure 5:
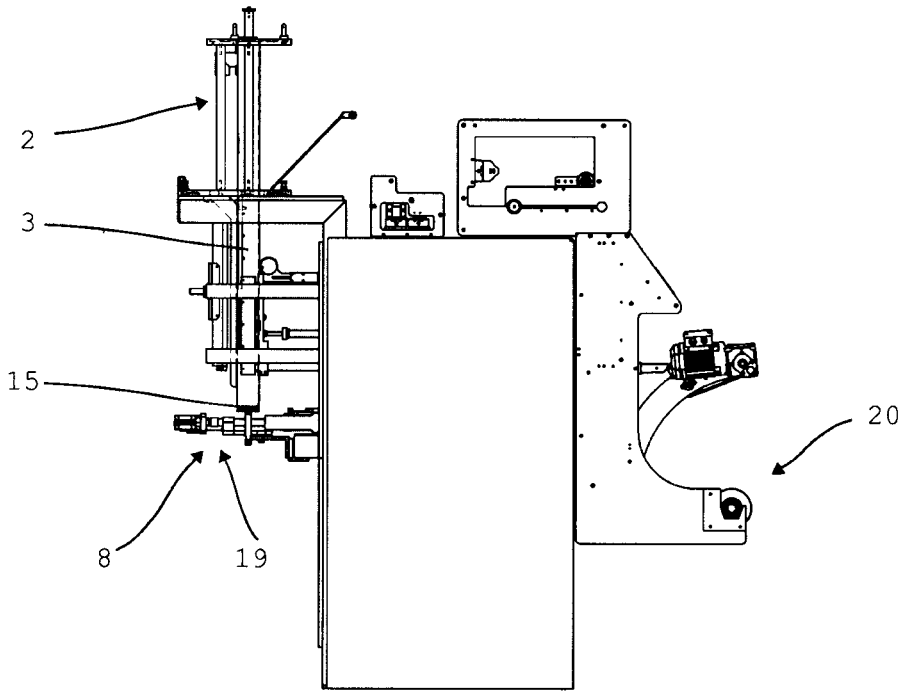
FIG. 5 a schematic illustration of a side view of an exemplary embodiment of an apparatus according to the invention for manufacturing an open-mouth bag.
Figure 6:
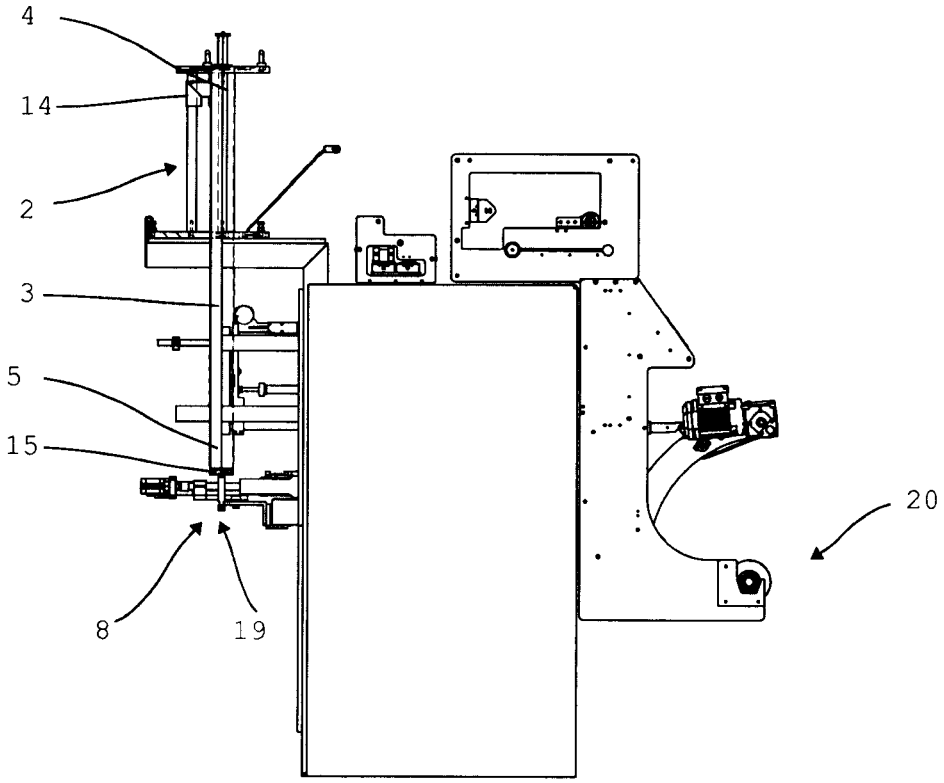
FIG. 6 the view according to FIG. 5, wherein some components have been omitted for better clarity.

FIG. 1 shows a perspective total view of an apparatus 200 for filling bulk goods and fluids into flexible open-top, open-mouth bags 100. The bags 100 processed in the apparatus 200 illustrated in FIG. 1 consist of a flexible bag material 101, presently of a plastic material or a film.

In the exemplary embodiment shown the apparatus 200 comprises an apparatus 1 according to the invention for manufacturing open-mouth bags 100, a transfer device 250, a filling carousel 201, and a compaction station, wherein the compaction station is not illustrated in the Figures.

The apparatus 1 according to the invention for manufacturing bags 100 provides bags which, in the exemplary embodiment shown, drop or glide into a transport box 251 of the transfer device 250. Then the transport box 251 pivots and allows the open-mouth bag 100 to drop down into the stock container 202 from above a stock container 202. In the stock container 202 the bag travels on the filling carousel 201 while being filled.

For manufacturing bags 100, bag material 101 is guided from a supply 20 over a shaping shoulder 22 around a shaping box 3, so that the bag material 101 sheet shows at least a minimal overlap. A closing device 7 forms a tube 102 from the bag material 101 draped around the shaping box 3, in which tube the closing station 8 then forms a bag bottom 103.

An open-mouth bag 100 must have a predetermined shape or contour so as to smoothly glide or drop both into the transport box 251 and the stock container 202. This is ensured by means of the apparatus according to the invention for manufacturing open-mouth bags. Moreover it is ensured that the filled bag retains its desired shape even in the case of subsequent compaction if any, or even extreme recompaction.

The FIGS. 2 to 6 schematically show various views of an exemplary embodiment of an apparatus 1 according to the invention for manufacturing empty bags 100.

The apparatus 1 comprises in the exemplary embodiment shown, other than a supply 20 for bag material 101, a diverter system 21 comprising several rollers, over which the layer of bag material 101 is fed to the shaping box 3 across a shaping shoulder 22, which is not shown in detail in the FIGS. 2 through 6. In the exemplary embodiment shown, the shaping shoulder 22 and the shaping box 3 form the shaping device 2.

The shaping box 3 shows the contour of the open-mouth bag 100 to be manufactured, wherein the layer or layers of bag material 101 are suitably fed to, or guided around, the shaping box 3 over the shaping shoulder 22, so that the bag material can be joined to form a tube 102 by means of a closing device 7, in the contour of the bag 100 to be formed.

The bag material 101 draped around the shaping box 3 is transported along the shaping box 3 by means of a conveying device 6, which in the exemplary embodiment shown comprises a pair of belt drives 23. The belt drives 23 urge the bag material 101 against the shaping box 3, thus transporting the bag material 101 or the tube 102 along the transporting direction 16 over the shaping box 3.

The shaping box 3 shows a top end 4 and a bottom end 5, with a closing station 8 provided beneath the bottom end 5, which, by making a bag bottom 103, manufactures from the tube 102 of bag material 101, a bag 100 or a bag blank, which is cut off of the tube 102 by means of a separator 19.

According to the invention a partial vacuum device 9 is provided, which generates at least a partial vacuum at the bottom end 5 of the shaping box 3.

Figure 7:
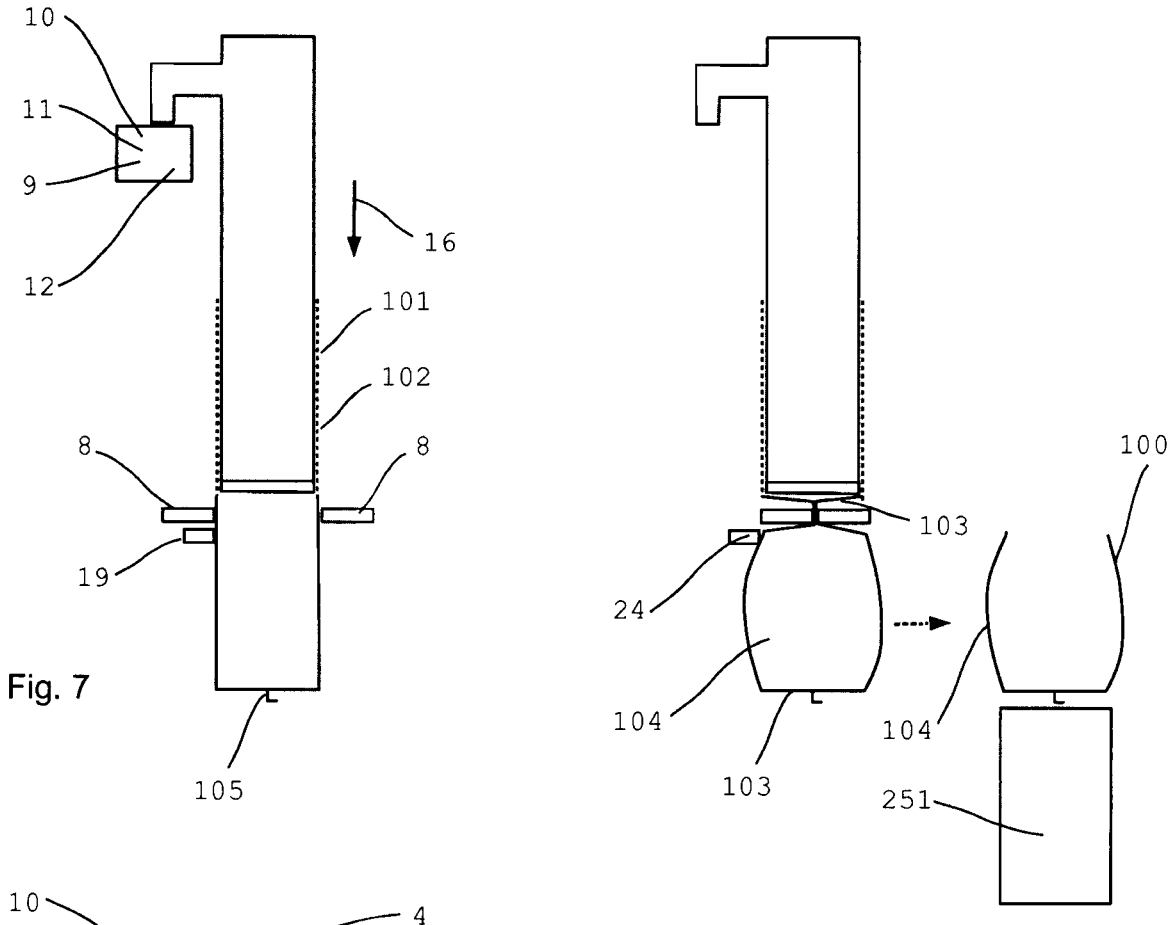
FIG. 7 a schematic illustration of a side view of an exemplary embodiment of an apparatus according to the invention for manufacturing an open-mouth bag.

FIG. 7 schematically illustrates an exemplary embodiment of an apparatus 1 according to the invention, for better clarity illustrating only the shaping box 3, the closing station 8, and the separator 19.

It can be seen that bag material 101 or a previously formed tube 102 of bag material 101 is transported along the shaping box 3, which shows the contour of the intended open-mouth bag 100.

FIG. 7 schematically illustrates what happens when the closing station 8 closes for forming a bag bottom 103. Since the tube 102 with the bag bottom 103 of the previously manufactured bag 100 is still appended beneath the shaping box 3, any air present in the tube 102 is also urged into the section of the tube 102 showing the bag bottom 103 which is positioned in the bottom in the transporting direction 16, as the closing station 8 closes for forming the bag bottom 103 of the following bag 100.

This causes the section to inflate and the bag walls 104 to bulge outwardly. Although the excess pressure now prevailing in the bag 100 escapes as soon as the separator 19, in this case a fly cutter 24, has cut off the open-mouth bag 100, which is then open on top, from the remainder of the tube 102. However, the bag walls 104 do not reset completely or satisfactorily. The drawback thereof is that the bag cannot glide as readily into a transport box 251 disposed beneath, nor can it glide into the stock container 202 later.

Figure 8:
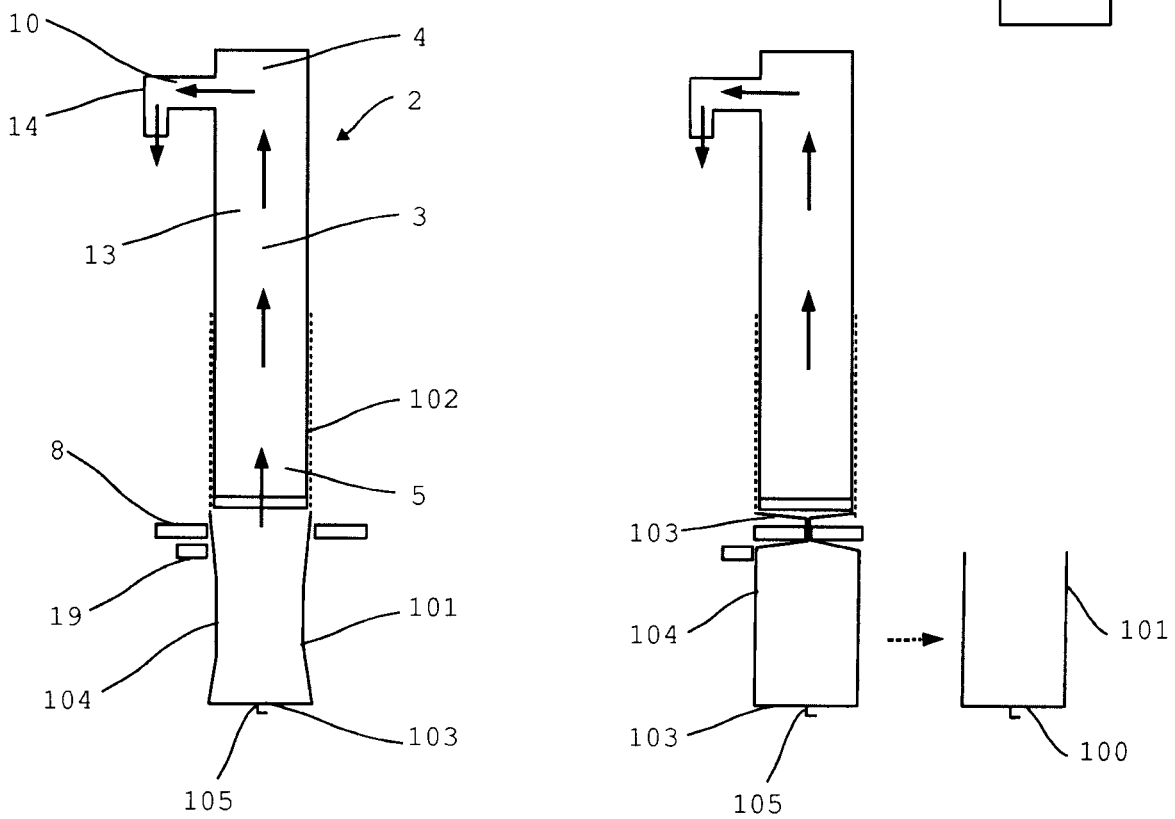
FIG. 8 a schematic illustration of a side view of an exemplary embodiment of an apparatus according to the invention for manufacturing an open-mouth bag.

FIG. 8 illustrates that in the exemplary embodiment shown, a partial vacuum is generated at the bottom end 5 of the shaping box 3 through a clear flow cross-section 13 inside of the shaping box 3, via a suction intake 14. The suction intake 14 is provided at the top end 4 of the shaping box. The top end 4 is not necessarily understood to mean the topmost section of the shaping box 3 but any section of the shaping box 3 which is not yet entirely enclosed in the bag material 101, so as to provide free access to the shaping box 3. Thus, optionally from above as well.

Presently, the partial vacuum is provided by a partial vacuum line 10 connected with the suction intake 14. Depending on the configuration, the partial vacuum device 9 may also comprise, for example a piston 11 and/or a Venturi device 12.

As indicated in FIG. 8, a slight partial vacuum is generated by means of the partial vacuum device 8 in the tube section of the previously formed bag, so that the bag wall 104 is slightly hollowed inwardly.

Now when the closing station 8 closes, air is again pressed out of the tube 102, also into the tube section beneath the closing station 8, so that in the shown example, the bag wall 104 once again bulges outwardly so as to form an open-mouth, empty bag 100 showing the desired contour, which is predetermined by the shaping box 3 and is suitable for further processing.

Moreover, by generating a slight partial vacuum, at least while the bag bottom 103 of the next bag 100 is being made, or while the closing station 8 is closing, it is achieved that the bag material 101 or the stacked layers of bag material 101 are not displaced during the making of the bag bottom 103, so as to generate a properly shaped bag bottom 103 or closing seam 105, for example in the form of a weld seam and/or glued seam.

Figure 9:
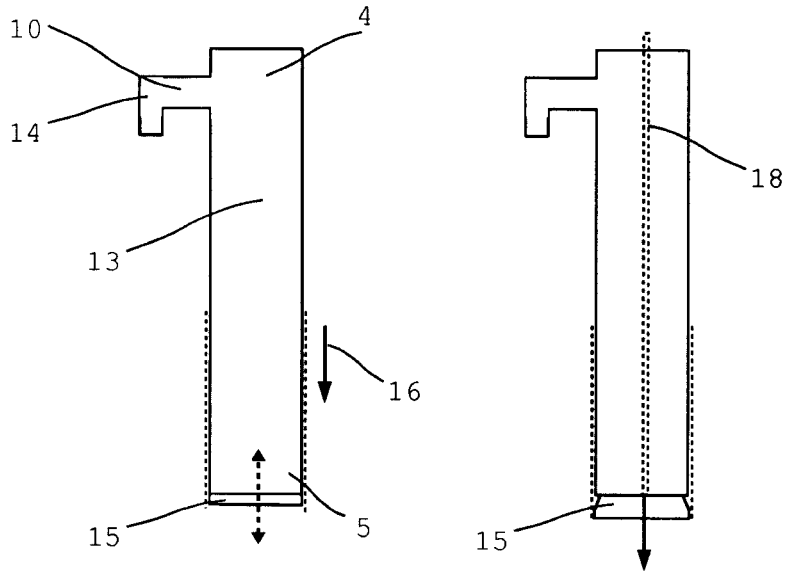
FIG. 9 a schematic illustration of a side view of an exemplary embodiment of an apparatus according to the invention for manufacturing an open-mouth bag.

FIG. 9 indicates schematically that the bottom end 5 of the shaping box 3 may be provided with a transport plunger 15 which can move in the transporting direction 16 and counter to the transporting direction 16. The transport plunger 15 in the shown exemplary embodiment is conical, so that at least part of the transport plunger 15 can be accommodated in the shaping box 3. Another section of the transport plunger 15 continues the outer contour of the shaping box 3. The outer periphery of the transport plunger 15 is preferably minimally smaller than the outer periphery of the shaping box, so that the film can readily glide across and is not pulled back during the reverse movement of the transport plunger 15.

The movement of the transport plunger 15 in the transporting direction 16 results in continued further conveying of the tube 102 formed around the shaping box 3, even if in this area, the conveying device 6 has lost contact with the tube 102, thus pushing the bag material 101. The transport plunger 15 eases the gliding off or the releasing or the setting in motion of the tube 102 off of the shaping box 3.

Moreover, FIG. 9 schematically illustrates that a pressure line 18 may be in functional connection with the bottom end 5 of the shaping box through the shaping box 3 or in another suitable way. Thus, the pressure line may cause generation of excess pressure in the last tube section so as to assist in transporting the bag 100 or the tube 102 prior to cutting off the bag 100.

Figure 10:
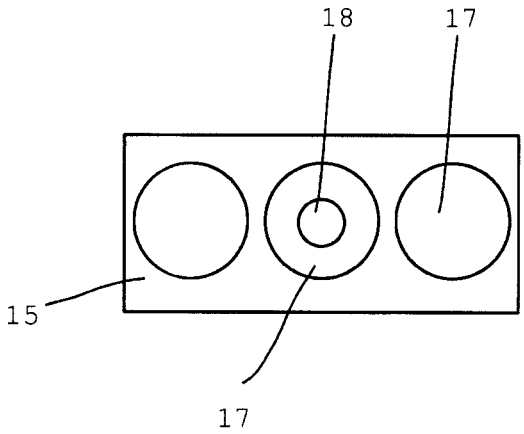
FIG. 10 a schematic view from below of a transport plunger in a shaping box.

FIG. 10 schematically shows a view from below of a transport plunger 15 in a shaping box 3. It can be seen that the transport plunger 15 fills the entire cross section of the shaping box 3, so as to prohibit the generation of a partial vacuum at the bottom end 5 of the shaping box 3 passing through the shaping box 3.

Therefore, several through holes 17 are provided in the transport plunger 15 in the exemplary embodiment shown, through which a partial vacuum applied through the shaping box 3 may also act at the bottom end 5 of the shaping box 3 through the transport plunger 15, or air can flow back in while the tube 102 is conveyed further.

Moreover, FIG. 10 illustrates that the pressure line 18 may also show its own through hole 17, or it may be disposed in another through hole 17, so that even a temporary excess pressure can be applied in the tube 102 beneath the shaping box 3 passing through the transport plunger.

While a particular embodiment of the present apparatus and method of manufacturing at least one empty, open-mouth bag has been described herein, it will be appreciated by those skilled in the art that changes and modifications may be made thereto without departing from the invention in its broader aspects and as set forth in the following claims.

LIST OF REFERENCE NUMERALS

1 apparatus
2 shaping device goods
3 shaping box
4 top end
5 bottom end
6 conveying device
7 closing device
8 closing station
9 partial vacuum device
10 partial vacuum line
11 piston
12 Venturi device
13 clear flow cross-section
14 suction intake
15 transport plunger
16 transporting direction
17 through hole
18 pressure line
19 separator
20 supply
21 diverter system
22 shaping shoulder
23 belt drive
24 fly cutter
100 open-mouth bag
101 bag material
102 tube
103 bag bottom
104 bag wall
105 closing seam (weld seam, glued seam)
200 filling apparatus for bulk
201 filling carousel
202 stock container
250 transfer device
251 transport box

The invention claimed is:

1. An apparatus for manufacturing at least one open-mouth bag of at least one layer of a substantially flexible bag material, comprising: at least one shaping device with at least one shaping box in a contour of the bag to be formed with a top end and a bottom end; at least one conveying device for transporting the bag material along the shaping box; at least one closing device for joining the bag material along the shaping box to form a tube; at least one closing station for making a bag bottom, disposed beneath the bottom end of the shaping box; and at least one partial vacuum device is provided, which is suitable and configured to generate, at least at the bottom end of the shaping box, at least intermittently, at least a minimal, partial vacuum;

wherein the minimal, partial vacuum is at least intermittently generated in the tube of the bag material at least prior to and/or during manufacturing the bag bottom of the next bag; and a transport plunger is displaced for transporting the tube and/or at least intermittently at least a minimal excess pressure is generated in the tube by means of a pressure line, for conveying the tube along the shaping box.

2. The apparatus according to claim 1, that the partial vacuum device comprises at least one partial vacuum line and/or at least one piston and/or at least one Venturi device.

3. The apparatus according to claim 1, characterized in that the shaping box comprises at least one clear flow cross-section from the top end to the bottom end and that the partial vacuum device at the top end is connected with the clear flow cross-section.

4. The apparatus according to claim 3, characterized in that at least the clear flow cross-section and the partial vacuum device do not provide a completely closed system.

5. The apparatus according to claim 1, characterized in that at least one suction intake is disposed at the shaping box.

6. The apparatus according to claim 1, characterized in that the partial vacuum generated by the partial vacuum device is adjustable.

7. The apparatus according claim 1, characterized in that at the bottom end of the shaping box, the at least one transport plunger is at least minimally displaceable in a transporting direction.

8. The apparatus according to claim 7, characterized in that at least one through hole is provided in the at least one transport plunger.

9. The apparatus according to claim 1, characterized in that the at least one pressure line is guided through the shaping box and is configured to generate, at least intermittently, at least a minimal excess pressure in the tube.

10. The apparatus according to claim 1, characterized in that at least one separator is attributed to the closing station.

11. A method of manufacturing at least one open-mouth bag with an apparatus according to claim 1, wherein at least one layer of a substantially flexible bag material is draped around the shaping box in a contour of a bag shape to be formed as continuous material, and is joined by means of the closing device to form a tube, and wherein the closing station manufactures a bag bottom, and at least prior to and/or during manufacturing the bag bottom of a next bag, at least a minimal partial vacuum is at least intermittently generated in the tube of the substantially flexible bag material by means of the partial vacuum device.

12. The method according to claim 11, characterized in that when making the bag bottom of a next bag, a finished bag is cut off by means of a separator.

* * * * *